US010267591B2

(12) United States Patent
Bednar

(10) Patent No.: US 10,267,591 B2
(45) Date of Patent: Apr. 23, 2019

(54) CROSSBOW BARREL

(71) Applicant: Hunter's Manufacturing Company, Inc., Suffield, OH (US)

(72) Inventor: Richard Bednar, Munroe Falls, OH (US)

(73) Assignee: Hunter's Manufacturing Co., Inc. d/b/a TenPoint Crossbow Technologies, Suffield, OH (US)

( * ) Notice: Subject to any disclaimer, the term of this patent is extended or adjusted under 35 U.S.C. 154(b) by 0 days.

(21) Appl. No.: 15/921,758

(22) Filed: Mar. 15, 2018

(65) Prior Publication Data

US 2019/0011213 A1 Jan. 10, 2019

Related U.S. Application Data

(60) Provisional application No. 62/529,051, filed on Jul. 6, 2017.

(51) Int. Cl.
*F41B 5/12* (2006.01)

(52) U.S. Cl.
CPC ..... *F41B 5/12* (2013.01); *F41B 5/123* (2013.01)

(58) Field of Classification Search
CPC .... F41B 5/12; F41B 5/123; F41B 5/14; F41B 5/1403
USPC ..... 124/25
See application file for complete search history.

(56) References Cited

U.S. PATENT DOCUMENTS 2,092,361 A 9/1937 Shirn
3,043,287 A 7/1962 Nelson
3,561,419 A 2/1971 Cucuzza, Sr.
3,670,711 A 6/1972 Firestone
3,739,765 A 6/1973 Moore
4,192,281 A 3/1980 King
4,246,883 A 1/1981 Ash
4,593,675 A 6/1986 Waiser
4,603,676 A 8/1986 Luoma
4,649,892 A 3/1987 Bozek
4,662,345 A 5/1987 Stephens
4,665,885 A 5/1987 Glomski et al.
4,719,897 A 1/1988 Gaudreau
4,721,092 A 1/1988 Waiser
4,942,861 A 7/1990 Bozek
5,115,795 A 5/1992 Farris
5,205,267 A 4/1993 Burdick
5,215,069 A 6/1993 Liu
5,220,906 A 6/1993 Choma
5,243,956 A 9/1993 Luehring
5,433,186 A 7/1995 Corwin
(Continued)

OTHER PUBLICATIONS

A Guide to the Crossbow, by W.F. Patterson, published by the Society of Archer-Antiquaries, 1990.
(Continued)

*Primary Examiner* — Alexander Niconovich
(74) *Attorney, Agent, or Firm* — Emerson Thomson Bennett, LLC

(57) ABSTRACT

Provided is a crossbow barrel comprising a first elongated shaft having a proximal end of the first elongated shaft and a distal end of the first elongated shaft opposite the proximal end of the first elongated shaft; and a second elongated shaft having a proximal end of the second elongated shaft, a distal end of the second elongated shaft opposite the proximal end of the second elongated shaft.

20 Claims, 5 Drawing Sheets

(56) References Cited

U.S. PATENT DOCUMENTS

| | | | | |
|---|---|---|---|---|
| 5,437,260 | A | 8/1995 | King | |
| 5,445,139 | A | 8/1995 | Bybee | |
| 5,553,596 | A * | 9/1996 | Bednar | F41B 5/12 124/25 |
| 5,598,829 | A | 2/1997 | Bednar | |
| 5,649,520 | A | 7/1997 | Bednar | |
| 5,678,528 | A | 10/1997 | Hadley | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,178,514 | B2 * | 2/2007 | Chang | F41B 5/123 124/25 |
| 7,624,724 | B2 * | 12/2009 | Bednar | F41B 5/123 124/25 |
| 7,624,725 | B1 | 12/2009 | Choma | |
| 7,784,453 | B1 | 8/2010 | Yehle | |
| 8,225,777 | B2 * | 7/2012 | Chu | F41B 5/123 124/25 |
| 8,443,790 | B2 | 5/2013 | Pestrue | |
| 8,499,753 | B2 | 8/2013 | Bednar | |
| 8,656,899 | B2 * | 2/2014 | Bednar | F41B 5/12 124/25 |
| 8,701,641 | B2 * | 4/2014 | Biafore, Jr. | F41B 5/1403 124/25 |
| 8,701,642 | B2 * | 4/2014 | Biafore, Jr. | F41B 5/123 124/25 |
| 8,813,735 | B2 * | 8/2014 | Biafore, Jr. | F41B 5/12 124/25 |
| 9,038,619 | B1 * | 5/2015 | Kempf | F41B 5/1426 124/89 |
| 9,121,659 | B1 * | 9/2015 | Chang | F41B 5/123 |
| 9,291,421 | B1 * | 3/2016 | Kempf | F41B 5/12 |
| 9,341,430 | B2 * | 5/2016 | McPherson | F41B 5/12 |
| 2006/0086346 | A1 | 4/2006 | Middleton | |
| 2010/0170488 | A1 | 7/2010 | Rasor et al. | |
| 2013/0291847 | A1 * | 11/2013 | Darlington | F41B 5/12 124/25 |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

CROSSBOW BARREL

CROSS-REFERENCE TO RELATED APPLICATIONS

This application claims the benefit of U.S. Provisional Application No. 62/529,051, filed Jul. 6, 2017, the entirety of which is fully incorporated by reference herein.

BACKGROUND

The present subject matter is directed to apparatuses and methods regarding crossbows. More specifically the present subject matter is directed to apparatuses and methods for a barrel for engaging a riser to a crossbow.

Crossbows have been used for many years as a weapon for hunting and fishing, and for target shooting. Crossbows typically comprise a set of limbs engaged to a barrel through a riser. Engagement of the riser to the barrel is of interest. It is of interest to make the engagement of the riser to the barrel reliable, light, inexpensive, low maintenance, and safe.

It remains desirable to improve the apparatuses and methods by which the engagement of the riser to the barrel is affected.

SUMMARY

Provided is a crossbow barrel comprising a first elongated shaft having a proximal end of the first elongated shaft and a distal end of the first elongated shaft opposite the proximal end of the first elongated shaft; and a second elongated shaft having a proximal end of the second elongated shaft, a distal end of the second elongated shaft opposite the proximal end of the second elongated shaft.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DEFINITIONS

Figure 1:
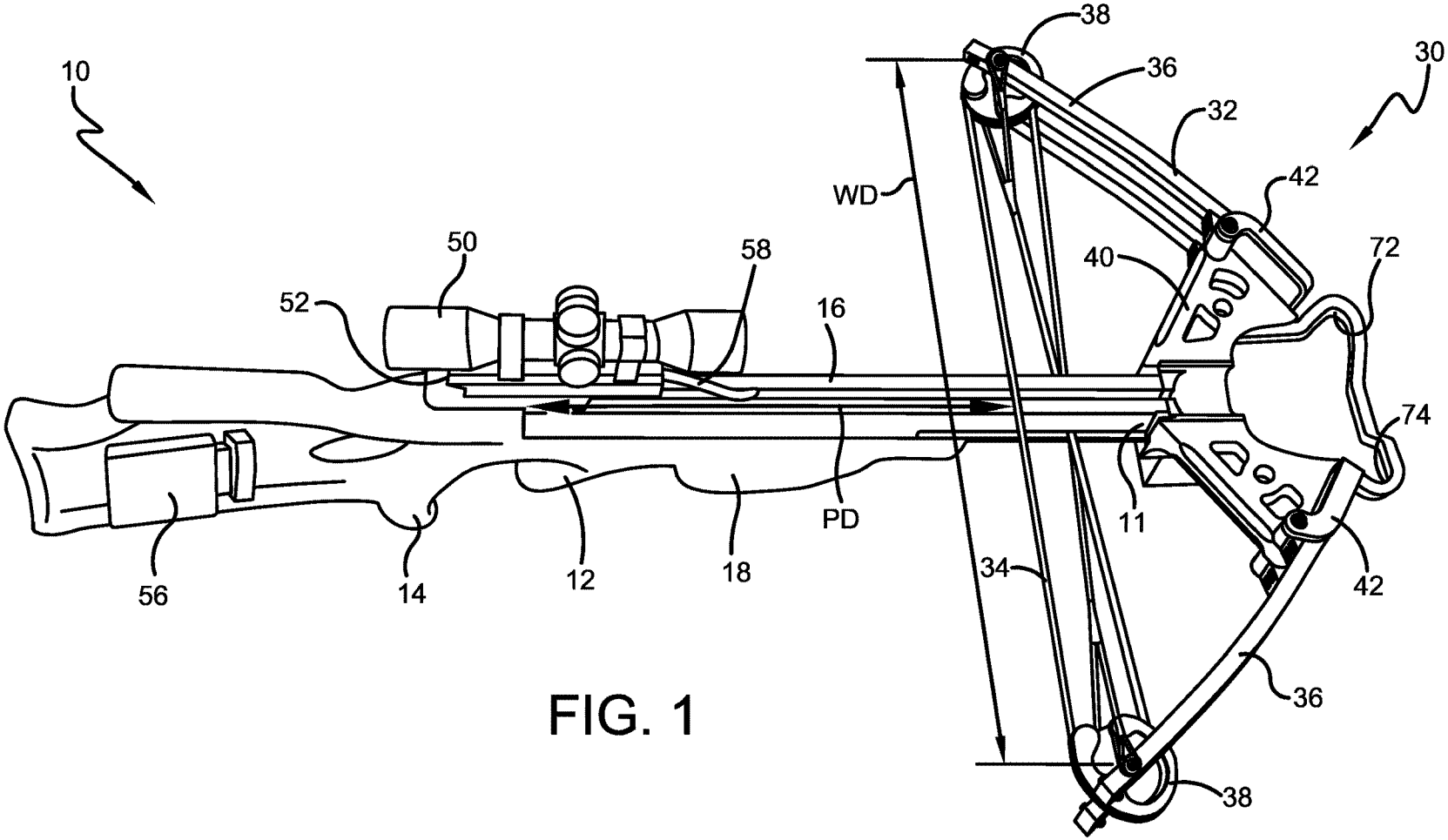
FIG. 1 is a view of one non-limiting embodiment of a crossbow.

The following definitions are controlling for the disclosed invention:

"Arrow" means a projectile that is shot with (or may be launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Referring now to the drawings wherein the showings are for purposes of illustrating embodiments of the present subject matter only and not for purposes of limiting the same, and wherein like reference numerals are understood to refer to like components, provided are a crossbow 10, crossbow components, and a method of assembling crossbow components.

Figure 4:
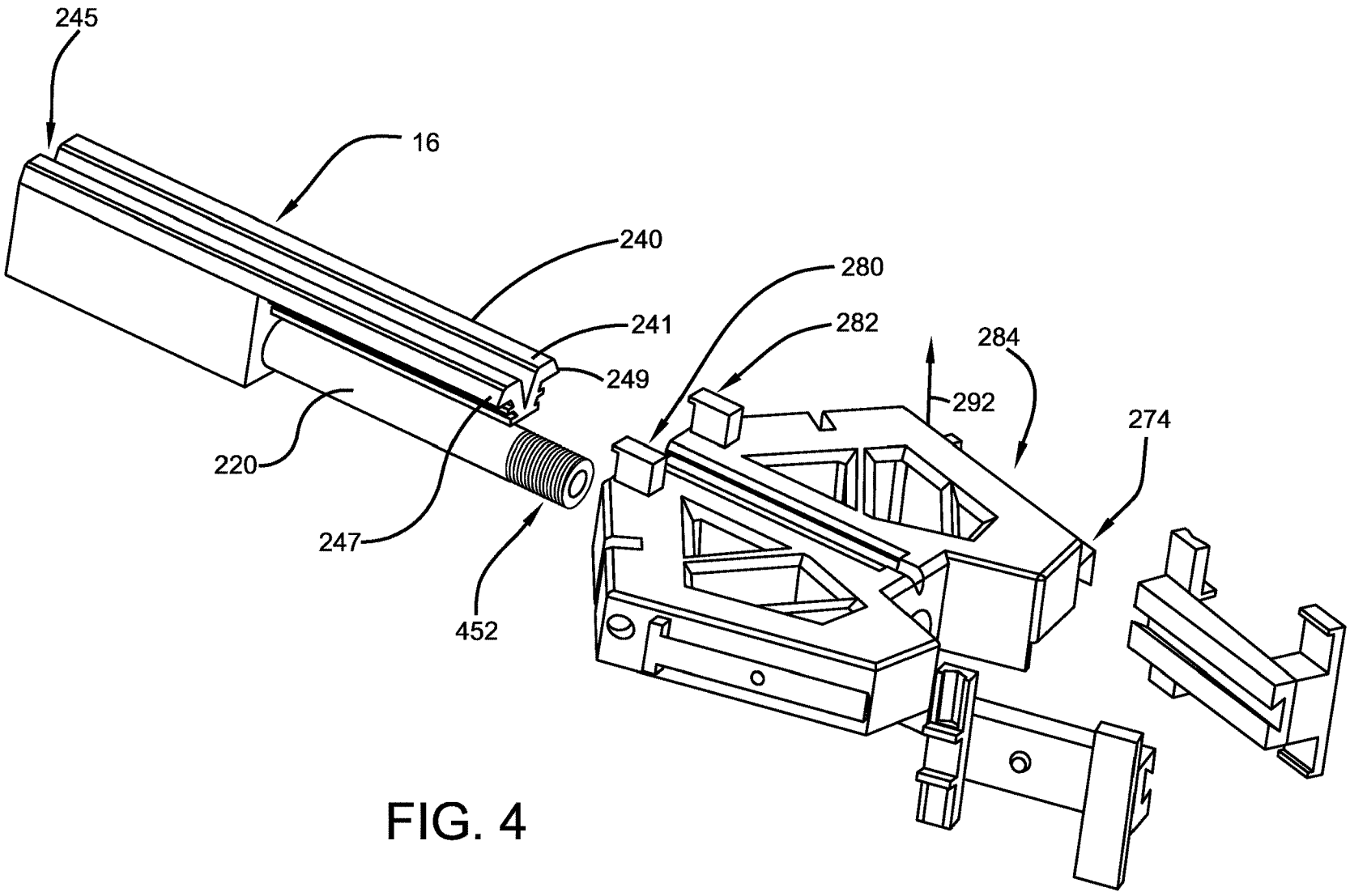
FIG. 4 is an exploded view of a barrel, riser assembly, with associated limb engagement hardware.

FIG. 1 shows a crossbow 10 according to one embodiment of the present subject matter. While the crossbow 10 shown uses a compound bow, it should be understood that this invention will work well with any type of crossbow chosen with sound judgment by a person of ordinary skill in the art. The crossbow 10 has a main beam 12 which may include a stock member 14, and a barrel 16. The main beam 12 may be made by assembling the stock member 14 and the barrel 16 together as separate components or, in another embodiment, the main beam 12 may be made as one piece. A handgrip 18 may be mounted to the main beam 12 in any conventional manner chosen with sound judgment by a person of ordinary skill in the art. A trigger mechanism 20 suitable for shooting an arrow is mounted to the main beam 12 in any suitable manner. It should be noted that the crossbow 10 may comprise any trigger mechanism chosen with sound judgment by a person of ordinary skill in the art. The crossbow 10 also includes a bow assembly 30 adapted to propel an associated arrow and having a bow 32 and a bowstring 34. The bow 32 may include a set of limbs 36, 36 that receive the bowstring 34 in any conventional manner chosen with sound judgment by a person of ordinary skill in the art. For the embodiment shown, a pair of wheels, pulleys, or cams 38, 38 mounted to the limbs 36, 36 receive the bowstring 34 in a known manner. The bow may also include a riser 40. The riser 40 may comprise a set of limb pockets 42, 42 adapted to receive the limbs 36, 36, as shown in FIG. 1. Alternatively, the riser 40 may comprise a set of rails or other limb pocket engagement components adapted to operatively engage limb pockets 42, 42 adapted to receive the limbs 36, 36, as shown in FIG. 4.

Without limitations, other crossbow components may be optionally used with a crossbow as provided herein. Without limitation, in some non-limiting embodiments, a crossbow 10 shown may include a scope 50 attached to a scope mount 52 that is supported on the main beam 12. Other optional components shown include a cocking unit 56. In certain non-limiting embodiments, the riser 40 may have an opening 72 formed therein defining a foot stirrup 74 adapted for holding and balancing the crossbow by foot.

A crossbow 10 may have a power stroke distance PD. The distance between the pivot axes of the wheels, pulleys, or cams 38, 38 may be some distance WD.

With reference now to FIGS. 1-5, a barrel 16 as provided by the present subject matter may take any of a wide variety of different forms. A crossbow barrel 16 may comprise a first elongated shaft 220 and a second elongated shaft 240. The first elongated shaft may have a proximal end 222 and a distal end 224 opposite the proximal end 222. The first elongated shaft 220 being elongated to define a first barrel axis of elongation 226 extending from the proximal end 222 of the first elongated shaft 220 to the distal end 224 of the first elongated shaft 220. A first barrel direction of elongation 228 may be defined as extending from the proximal end 222 of the first elongated shaft 220 to the distal end 224 of the first elongated shaft 220.

The second elongated shaft 240 may have a proximal end 242 of the second elongated shaft and a distal end 244 of the second elongated shaft 240 opposite the proximal end 242 of the second elongated shaft 240. The second elongated shaft 240 may be elongated to define a second barrel axis of elongation 246 extending from the proximal end 242 of the second elongated shaft 240 to the distal end 244 of the second elongated shaft 240. A second barrel direction of elongation 248 may be defined as extending from the proximal end 242 of the second elongated shaft 240 to the distal end 244 of the second elongated shaft 240.

Figure 2A:
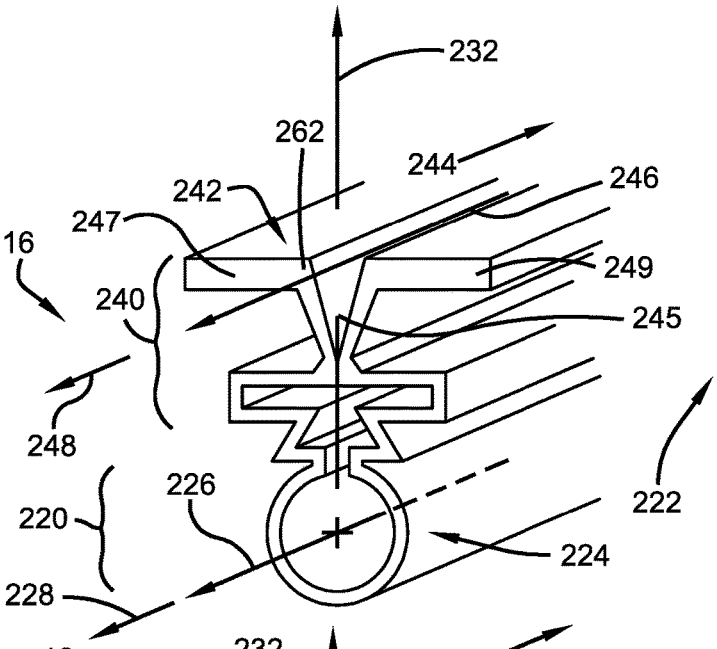
FIG. 2*a* is a view of a first non-limiting embodiment of a barrel.
Figure 2B:
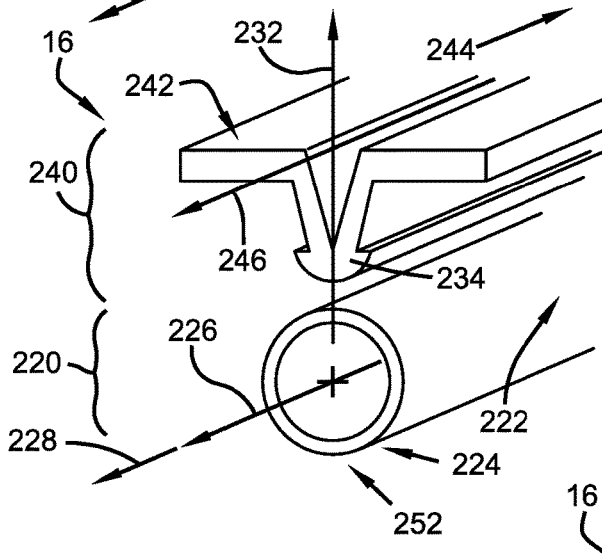
FIG. 2*b* is a view of a second non-limiting embodiment of a barrel
Figure 2C:
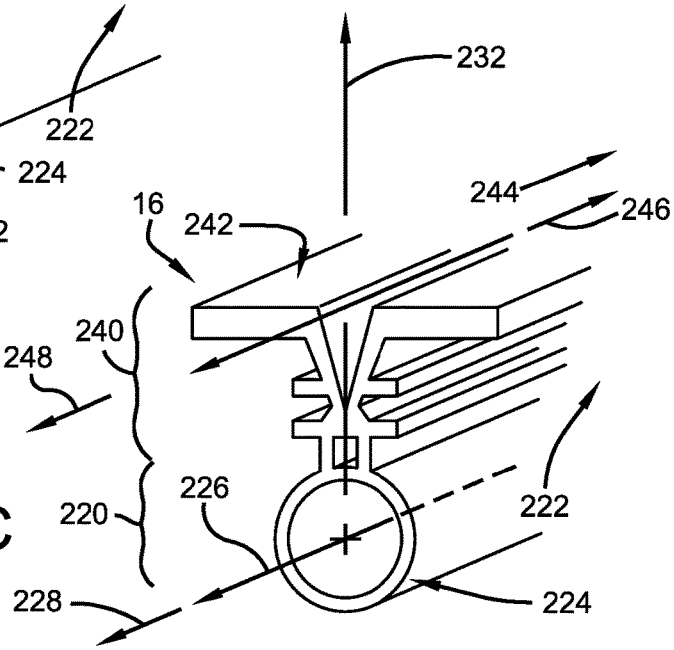
FIG. 2*c* is a view of a third non-limiting embodiment of a barrel
Figure 5:
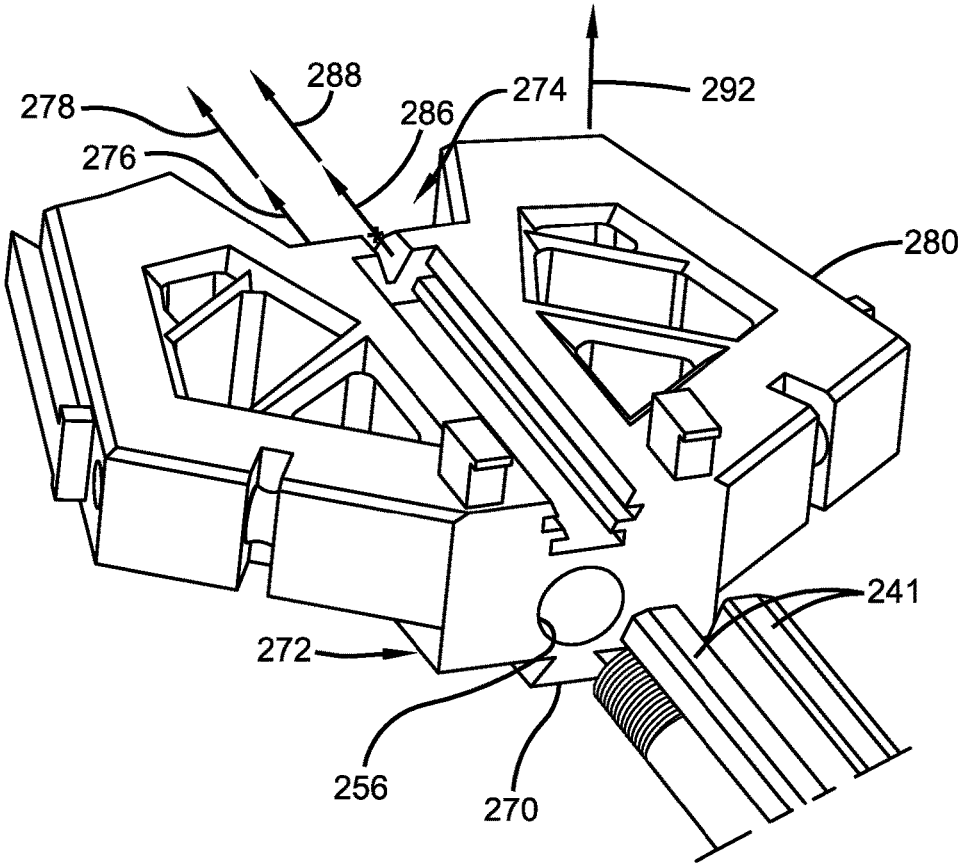
FIG. 5 is an exploded view of a barrel, riser assembly, with associated limb engagement hardware.

With continuing reference to the non-limiting embodiments shown in FIGS. 2*a*-2*c*, in some embodiments the second barrel axis of elongation 246 is parallel to the first barrel axis of elongation 226. In some embodiments, the second barrel axis of elongation 246 is offset from the first barrel axis of elongation 226 in a direction defining a top barrel direction 232 perpendicular to the first barrel axis of elongation 226. In some embodiments, the first barrel direction of elongation 228 and the second barrel direction of elongation 248 are offset from one another by some offset distance 234 and point in the same direction. In some embodiments, the first elongated shaft 220 has a cross-section area 252 normal to the first barrel axis of elongation 226 that is circular, and the first elongated shaft 220 has engagement components 352, 452 adapted to operationally engage with a counterpart component 354. In some non-limiting embodiments and as shown in FIGS. 3*b*, 4, and 5, the engagement components 352, 452 may be threads 452. The thread 452 may be male or female threads.

As shown in FIGS. 3*b* and 4, in some non-limiting embodiments, the first elongated shaft 220 may have engagement components 352 which are external threads 352 adapted to threadedly engage with an internally-threaded counterpart component 354. Alternatively, the engagement components 352 may be internal threads adapted to threadedly engage with an externally-threaded counterpart component.

Figure 3A:
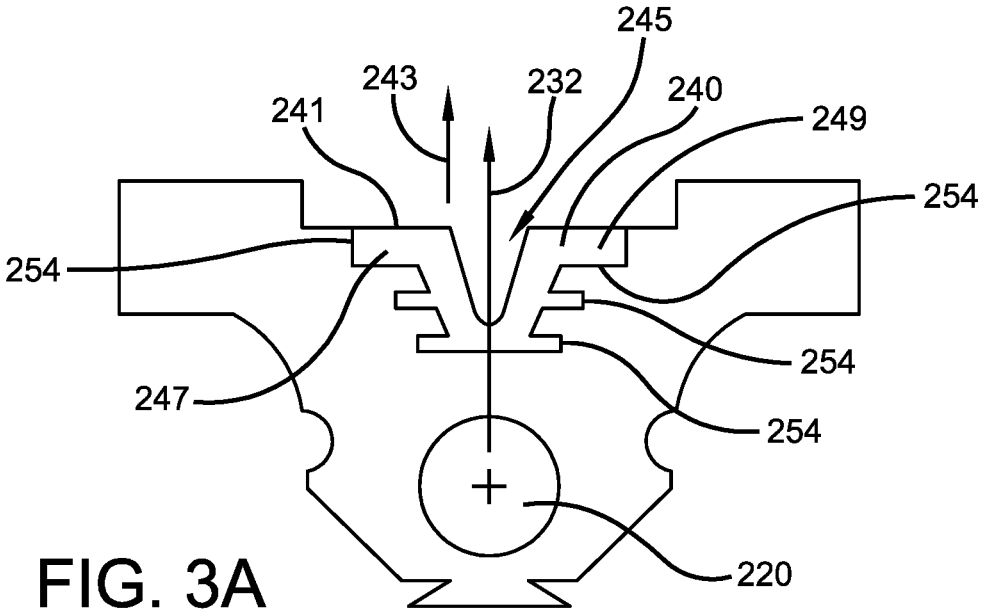
FIG. 3*a* is a close up end view of a first non-limiting embodiment of a barrel engaged with a riser.
Figure 3B:
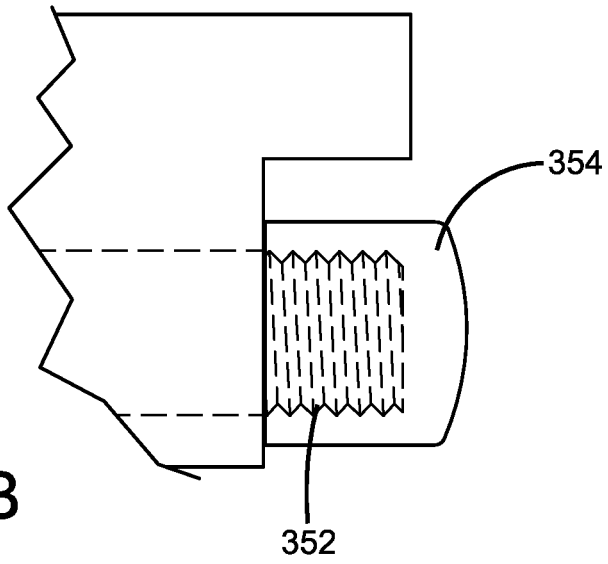
FIG. 3*b* is a close up side view of a first non-limiting embodiment of a barrel engaged with a riser

As shown in FIGS. 3*a*, 4, and 5, in some non-limiting embodiments, the second elongated shaft 240 may have a top barrel side 241 having a normal direction 243 pointing in the top barrel direction 232. In some non-limiting embodiments, the second elongated shaft 240 may have an elongated recess 245 therein parallel to the second barrel axis of elongation 246, the elongated recess 245 dividing the top barrel side 241 into a first lateral portion 247 and a second lateral portion 249 opposite the first lateral portion 247 across the elongated recess 245.

As shown in FIGS. 2*a*-5, in some non-limiting embodiments, the first elongated shaft 220 has a cross-section area 252 normal to the first barrel axis of elongation that is constant in area from the proximal end 222 of the first elongated shaft to the distal end 224 of the first elongated shaft; or has a cross-section area 252 normal to the first barrel axis of elongation that does not increase in area in first barrel direction of elongation 228. In some non-limiting embodiments, the second elongated shaft 240 has a cross-section area 254 normal to the second barrel axis of elongation 246, that is constant in area from the proximal end 242 of the second elongated shaft to the distal end 244 of the second elongated shaft; or has a cross-section area 254 normal to the second barrel axis of elongation 246 that does not increase in area in the second barrel direction of elongation 248. In some non-limiting embodiments, the first elongated shaft 220 has a cross-section area 252 normal to the first barrel axis of elongation 226 that decreases in first barrel direction of elongation 228. In some non-limiting embodiments, the second elongated shaft 240 has a cross-section area 262 normal to the second barrel axis of elongation 246 that decreases in the second barrel direction of elongation 248.

As shown in FIGS. 2*a*-5, in some non-limiting embodiments, the second elongated shaft 240 may have one or more fins 254. Without limitation, the fins 254 may be parallel to one another. Without limitation the fins 254 may extend in a plane normal to the top barrel direction 232. In some embodiments, the second elongated shaft 240 may have at least a first fin 254 extending in plane normal to the top barrel direction 232 from the first lateral portion 247 away from the elongated recess 245 and at least a second fin 254 extending in plane normal to the top barrel direction 232 from the second lateral portion 249 away from the elongated recess 245.

With continued reference to FIGS. 1-5, in certain non-limiting embodiments a crossbow 10 may comprise a crossbow barrel 16, a riser 40. and a set of crossbow limbs 36.

The crossbow barrel 16 may have a first elongated shaft 220 having a proximal end 222 of the first elongated shaft and a distal end 224 of the first elongated shaft opposite the proximal end 222 of the first elongated shaft, the first elongated shaft 220 being elongated to define a first barrel axis of elongation 226 extending from the proximal end 222 of the first elongated shaft to the distal end 224 of the first elongated shaft, and a first barrel direction of elongation 228 extending from the proximal end 222 of the first elongated shaft to the distal end 224 of the first elongated shaft.

The crossbow barrel 16 may have a second elongated shaft 240 having a proximal end 242 of the second elongated shaft and a distal end 244 of the second elongated shaft opposite the proximal end 242 of the second elongated shaft, the second elongated shaft being elongated to define a second barrel axis of elongation 246 extending from the proximal end 242 of the second elongated shaft to the distal end 244 of the second elongated shaft, and a second barrel direction of elongation 248 extending from the proximal end 242 of the second elongated shaft to the distal end 244 of the second elongated shaft.

The second barrel axis of elongation 248 may be parallel to the first barrel axis of elongation 228. The second barrel axis of elongation 248 may be offset from the first barrel axis of elongation 228 in a direction defining a top barrel direction 232 perpendicular to the first barrel axis of elongation 228. The first barrel direction of elongation 228 and the second barrel direction of elongation 248 are offset and point in the same direction. The first elongated shaft 220 may have a cross-section area 252 normal to the first barrel axis of elongation 226 that is circular, elliptical, hexagonal, square, triangular, or other shape chosen with good engineering judgment. The first elongated shaft 220 may have engagement components 352, 452 adapted to operationally engage with a counterpart component 354.

The riser 40 may have a first elongated channel 270 having a proximal end 272 of the first elongated channel 270 and a distal end 274 of the first elongated channel 270 opposite the proximal end 272 of the first elongated channel. The first elongated channel 270 may be elongated to define a first riser axis of elongation 276 extending from the proximal end 272 of the first elongated channel 270 to the distal end 274 of the first elongated channel 270, and a first riser direction of elongation 278 extending from the proximal end 272 of the first elongated channel 270 to the distal end 274 of the first elongated channel 270. The riser 40 may have a second elongated channel 280 having a proximal end 282 of the second elongated channel 280 and a distal end 284 of the second elongated channel 280 opposite the proximal end 282 of the second elongated channel 280. The second elongated channel may be elongated to define a second riser axis of elongation 286 extending from the proximal end 282 of the second elongated channel 280 to the distal end 284 of the second elongated channel 280, and a second riser direction of elongation 288 extending from the proximal end 282 of the second elongated channel 280 to the distal end 284 of the second elongated channel 280. The second riser axis of elongation 286 may be parallel to the first riser axis of elongation 276. The second riser axis of elongation 286 may be offset from the first riser axis of elongation 276 in a direction defining a top riser direction 292 perpendicular to the first riser axis of elongation 276. The first riser direction of elongation 278 and the second riser direction of elongation 288 may be offset and point in the same direction. The first riser elongated channel 270 may have a cross-section area 256 normal to the first riser axis of elongation 276 that is circular, elliptical, hexagonal, square, triangular, or other shape chosen with good engineering judgment.

In some non-limiting embodiments, the riser 40 may be operationally engaged with the crossbow barrel 16 in such a way that the first elongated shaft 220 is inserted within the first elongated channel 270, the second elongated shaft 240 is inserted within the second elongated channel 280. In some non-limiting embodiments, the first barrel direction of elongation 228 is parallel with and is in the same direction as the first riser direction of elongation 278, the second barrel direction of elongation 248 is parallel with and is in the same direction as the second riser direction of elongation 288, and the riser 40 is restrained from moving with respect to the barrel 16. In some non-limiting embodiments, a counterpart component 354 is operationally engaged with the first elongated shaft 220. This operational engagement may be of such a nature that it abuts the riser 40 or otherwise constrains the riser from sliding along the first elongated shaft 220 at least in one direction. In some embodiments in which the riser is engaged with more than one elongated barrel shaft and abuts the barrel 16 in a first direction, the riser 40 may be slidably installed with the barrel 16 and then selectably fixed in place by the counterpart component 354. A set of crossbow limbs 36 may be operationally engaged with the riser 40. In some non-limiting embodiments, the counterpart component 354 may be a single bolt or nut which threads into engagement with the barrel 16 to clamp the riser 40 between the barrel 16 and the counterpart component 354. In some non-limiting embodiments, the counterpart component 354 may be a quarter-turn fastener which may be engaged with the barrel 16 to clamp the riser 40 between the barrel 16 and the counterpart component 354, but which permits the riser 40 to be selectably engaged or disengaged from the barrel 16 quickly.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

What is claimed is:

1. A crossbow barrel comprising a first elongated shaft having a proximal end of the first elongated shaft, a distal end of the first elongated shaft opposite the proximal end of the first elongated shaft, the first elongated shaft being elongated to define a first barrel axis of elongation extending from the proximal end of the first elongated shaft to the distal end of the first elongated shaft, and a first barrel direction of elongation extending from the proximal end of the first elongated shaft to the distal end of the first elongated shaft; and a second elongated shaft having a proximal end of the second elongated shaft, a distal end of the second elongated shaft opposite the proximal end of the second elongated shaft, a top side, the second elongated shaft being elongated to define a second barrel axis of elongation extending from the proximal end of the second elongated shaft to the distal end of the second elongated shaft, and a second barrel direction of elongation extending from the proximal end of the second elongated shaft to the distal end of the second elongated shaft;

wherein, the second barrel axis of elongation is parallel to the first barrel axis of elongation, the second barrel axis of elongation is offset from the first barrel axis of elongation in a direction defining a top barrel direction perpendicular to the first barrel axis of elongation, the first barrel direction of elongation and the second barrel direction of elongation are offset and point in the same direction, the first elongated shaft has a cross-section area normal to the first barrel axis of elongation that is circular, and the first elongated shaft has engagement components adapted to operationally engage with a counterpart component; and wherein, a) the first elongated shaft is tapered such that it decreases in cross-section area normal to the first barrel axis of elongation in the first barrel direction of elongation, or b) the top side has an elongated recess therein parallel to the second barrel axis of elongation, the elongated recess dividing the top barrel side into, a first lateral portion having a plurality of fins extending in plane normal to the top barrel direction away from the elongated recess, and a second lateral portion opposite the first lateral portion across the elongated recess, the second lateral portion having a plurality of fins extending in plane normal to the top barrel direction away from the elongated recess.

2. The crossbow barrel of claim 1, wherein the first elongated shaft has external threads adapted to threadedly engage with an internally-threaded counterpart component.

3. The crossbow barrel of claim 2, wherein the top side has a normal direction pointing in the top barrel direction.

4. The crossbow barrel of claim 3, wherein the top side has an elongated recess therein parallel to the second barrel axis of elongation, the elongated recess dividing the top barrel side into a first lateral portion and a second lateral portion opposite the first lateral portion.

5. The crossbow barrel of claim 4, wherein the first elongated shaft is tapered such that it decreases in cross-section area normal to the first barrel axis of elongation in the first barrel direction of elongation.

6. The crossbow barrel of claim 5, wherein the second elongated shaft is tapered such that it decreases in cross-section area normal to the second barrel axis of elongation in the second barrel direction of elongation.

7. The crossbow barrel of claim 6, wherein the second elongated shaft has one or more fins, each of the fins extending in plane normal to the top barrel direction.

8. The crossbow barrel of claim 7, wherein the second elongated shaft has a first fin extending in plane normal to the top barrel direction from the first lateral portion away from the elongated recess;

a second fin extending in plane normal to the top barrel direction from the first lateral portion away from the elongated recess;

a first fin extending in plane normal to the top barrel direction from the second lateral portion away from the elongated recess; and at least a second fin extending in plane normal to the top barrel direction from the second lateral portion away from the elongated recess.

9. A crossbow comprising a crossbow barrel having a first elongated shaft having a proximal end of the first elongated shaft and a distal end of the first elongated shaft opposite the proximal end of the first elongated shaft, the first elongated shaft being elongated to define a first barrel axis of elongation extending from the proximal end of the first elongated shaft to the distal end of the first elongated shaft, and a first barrel direction of elongation extending from the proximal end of the first elongated shaft to the distal end of the first elongated shaft; and a second elongated shaft having a proximal end of the second elongated shaft and a distal end of the second elongated shaft opposite the proximal end of the second elongated shaft, the second elongated shaft being elongated to define a second barrel axis of elongation extending from the proximal end of the second elongated shaft to the distal end of the second elongated shaft, and a second barrel direction of elongation extending from the proximal end of the second elongated shaft to the distal end of the second elongated shaft; and wherein, the second barrel axis of elongation is parallel to the first barrel axis of elongation, the second barrel axis of elongation is offset from the first barrel axis of elongation in a direction defining a top barrel direction perpendicular to the first barrel axis of elongation the first direction of elongation and the second direction of elongation are offset and point in the same direction, the first elongated shaft has a cross-section area normal to the first barrel axis of elongation that is circular, and the first elongated shaft has engagement components adapted to operationally engage with a counterpart component;

a riser having a first elongated channel defining a through hole in the riser, the first elongated channel having a proximal end of the first elongated channel and a distal end of the first elongated channel opposite the proximal end of the first elongated channel, the first elongated channel being elongated to define a first riser axis of elongation extending from the proximal end of the first elongated channel to the distal end of the first elongated channel, and a first riser direction of elongation extending from the proximal end of the first elongated channel to the distal end of the first elongated channel; and a second elongated channel having a proximal end of the second elongated channel and a distal end of the second elongated channel opposite the proximal end of the second elongated channel, the second elongated channel being elongated to define a second riser axis of elongation extending from the proximal end of the second elongated channel to the distal end of the second elongated channel, and a second riser direction of elongation extending from the proximal end of the second elongated channel to the distal end of the second elongated channel; and wherein, the second riser axis of elongation is parallel to the first riser axis of elongation, the second riser axis of elongation is offset from the first riser axis of elongation in a direction defining a top riser direction perpendicular to the first riser axis of elongation the first riser direction of elongation and the second riser direction of elongation are offset and point in the same direction, and the first riser elongated channel has a cross-section area normal to the first riser axis of elongation that is circular;

a set of crossbow limbs operationally engaged with the riser;

wherein the riser is operationally engaged with the crossbow barrel in such a way that the first elongated shaft is inserted within the proximal end of the first elongated channel to extend through the first elongated channel and protrude from the distal end of the first elongated channel, the second elongated shaft is inserted within the second elongated channel, the first barrel direction of elongation is parallel with and is in the same direction as the first riser direction of elongation, the second barrel direction of elongation is parallel with and is in the same direction as the second riser direction of elongation, and the riser is restrained from moving with respect to the barrel; and a counterpart component operationally engaged with the first elongated shaft and the riser to restrain the riser from moving with respect to the crossbow barrel.

10. The crossbow of claim 9, wherein the first elongated shaft has external threads adapted to threadedly engage with an internally-threaded counterpart component.

11. The crossbow of claim 10, wherein the second elongated shaft has a top side having a normal direction pointing in the top barrel direction.

12. The crossbow of claim 11, wherein the top side has an elongated recess therein parallel to the second barrel axis of elongation, the elongated recess dividing the top barrel side into a first lateral portion and a second lateral portion opposite the first lateral portion.

13. The crossbow of claim 12, wherein the first elongated shaft has a cross-section area normal to the first barrel axis of elongation that decreases by tapering in first barrel direction of elongation.

14. The crossbow of claim 13, wherein the second elongated shaft has a cross-section area normal to the second barrel axis of elongation that decreases by tapering in the second barrel direction of elongation.

15. The crossbow of claim 14, wherein the first elongated channel has a cross-section area normal to the first riser axis of elongation that decreases by tapering in first riser direction of elongation.

16. The crossbow of claim 15, wherein the second elongated channel shaft has a cross-section area normal to the second barrel axis of elongation that decreases by tapering in the second barrel direction of elongation.

17. A method of assembling a crossbow comprising providing a crossbow barrel having a first elongated shaft having a proximal end of the first elongated shaft and a distal end of the first elongated shaft opposite the proximal end of the first elongated shaft, the first elongated shaft being elongated to define a first barrel axis of elongation extending from the proximal end of the first elongated shaft to the distal end of the first elongated shaft, and a first barrel direction of elongation extending from the proximal end of the first elongated shaft to the distal end of the first elongated shaft, and a second elongated shaft having a proximal end of the second elongated shaft and a distal end of the second elongated shaft opposite the proximal end of the second elongated shaft, the second elongated shaft being elongated to define a second barrel axis of elongation extending from the proximal end of the second elongated shaft to the distal end of the second elongated shaft, and a second barrel direction of elongation extending from the proximal end of the second elongated shaft to the distal end of the second elongated shaft, and wherein, the second barrel axis of elongation is parallel to the first barrel axis of elongation, the second barrel axis of elongation is offset from the first barrel axis of elongation in a direction defining a top barrel direction perpendicular to the first barrel axis of elongation the first direction of elongation and the second direction of elongation are offset and point in the same direction, the first elongated shaft has a cross-section area normal to the first barrel axis of elongation that is circular, and the first elongated shaft has engagement components adapted to operationally engage with a counterpart component;

providing a riser having a first elongated channel defining a through hole in the riser, the first elongated channel having a proximal end of the first elongated channel and a distal end of the first elongated channel opposite the proximal end of the first elongated channel, the first elongated channel being elongated to define a first riser axis of elongation extending from the proximal end of the first elongated channel to the distal end of the first elongated channel, and a first riser direction of elongation extending from the proximal end of the first elongated channel to the distal end of the first elongated channel; and a second elongated channel having a proximal end of the second elongated channel and a distal end of the second elongated channel opposite the proximal end of the second elongated channel, the second elongated channel being elongated to define a second riser axis of elongation extending from the proximal end of the second elongated channel to the distal end of the second elongated channel, and a second riser direction of elongation extending from the proximal end of the second elongated channel to the distal end of the second elongated channel; and wherein, the second riser axis of elongation is parallel to the first riser axis of elongation, the second riser axis of elongation is offset from the first riser axis of elongation in a direction defining a top riser direction perpendicular to the first riser axis of elongation the first riser direction of elongation and the second riser direction of elongation are offset and point in the same direction, and the first riser elongated channel has a cross-section area normal to the first riser axis of elongation that is circular;

operationally engaging the riser with the crossbow barrel in such a way that the first elongated shaft is inserted within the proximal end of the first elongated channel to extend through the first elongated channel and protrude from the distal end of the first elongated channel, the second elongated shaft is inserted within the second elongated channel, and the riser is restrained from moving with respect to the barrel; and operationally engaging a counterpart component with the first elongated shaft.

18. The method of assembling a crossbow of claim 17 further comprising threadedly engaging the counterpart component with the first elongated shaft.

19. The method of assembling a crossbow of claim 18, wherein the first elongated shaft has a cross-section area normal to the first barrel axis of elongation that decreases by tapering in first barrel direction of elongation.

20. The method of assembling a crossbow of claim 19, wherein the first elongated channel has a cross-section area normal to the first riser axis of elongation that decreases by tapering in first riser direction of elongation.

* * * * *